US005492091A

United States Patent [19]

Russ

[11] Patent Number: 5,492,091

[45] Date of Patent: Feb. 20, 1996

[54] THERMALLY CONDUCTIVE VALVE SEAT INSERT ASSEMBLY

[75] Inventor: Stephen G. Russ, Canton, Mich.

[73] Assignee: Ford Motor Company, Dearborn, Mich.

[21] Appl. No.: 363,069

[22] Filed: Dec. 23, 1994

[51] Int. Cl.[6] ..... F01L 3/04

[52] U.S. Cl. ..... 123/188.3; 123/188.8; 29/888.06; 29/888.061; 29/888.44; 251/362

[58] Field of Search ..... 123/188.3, 188.8; 29/888.06, 888.061, 888.44; 251/362; 137/468

[56] References Cited

U.S. PATENT DOCUMENTS

| | | | |
|---|---|---|---|
| 2,517,114 | 8/1947 | Karcher et al. | 123/188.8 |
| 2,753,859 | 3/1952 | Bartlett | 123/188.8 |
| 4,217,875 | 8/1980 | Elsbett et al. | 123/188.8 |
| 4,676,482 | 6/1987 | Reece et al. | 251/362 |
| 4,723,518 | 2/1988 | Kawasaki et al. | 123/188.3 |
| 5,020,490 | 6/1991 | Seko | 123/188.8 |
| 5,182,854 | 2/1993 | Voss | 29/888.06 |

FOREIGN PATENT DOCUMENTS

| | | | |
|---|---|---|---|
| 55-91715 | 7/1980 | Japan | 123/188.8 |
| 56-88909 | 7/1981 | Japan | 123/188.8 |
| 0674007 | 3/1994 | Japan | 29/888.44 |

*Primary Examiner*—Erick R. Solis
*Attorney, Agent, or Firm*—David B. Kelley; Roger L. May

[57] ABSTRACT

A cylinder head in an internal combustion engine has a number of valve seat insert bores with a thermally conductive paste applied to an inner surface thereof. A valve seat insert is fitted into each cylinder head bore and the paste fills voids, or air gaps, along the contact surface between the inserts and the bores. The paste is made from a metal powder and a binder material which aggressively bonds to the metal powder, to the inserts and to the bores to form a thermally conductive solid material therebetween.

17 Claims, 1 Drawing Sheet

THERMALLY CONDUCTIVE VALVE SEAT INSERT ASSEMBLY

FIELD OF THE INVENTION

The present invention relates generally to automotive valve seat insert assemblies, and, more particularly, to a valve seat insert paste applied between the valve seat insert and the cylinder head of an internal combustion engine to increase thermal conduction therebetween.

BACKGROUND OF THE INVENTION

Combustion in the cylinders of an internal combustion engine generates waste heat which must be removed to allow proper operation of engine components. The engine valves and valve seat inserts are two such component exposed to the high combustion temperatures. The valve seat inserts are typically made of material with thermal properties which accommodate valve expansion and contraction. Unless the valve seat inserts are properly cooled, however, the valves may not seat properly potentially resulting in engine "knock".

In most engines, conductive cooling of the valve seat inserts, which is the dominant heat transfer mechanism, is accomplished through heat conduction to the adjacent cylinder head in which it is fitted. Although closely toleranced, voids typically exist between the valve insert and the cylinder head. These voids raise the thermal contact resistance between the insert and the head which can result in a significant valve insert temperature rise, perhaps exceeding 100° F.

Use of a metallic coating on the valve insert which melts at engine operating temperatures was disclosed in U.S. Pat. No. 2,517,114 (Karcher) to improve the thermal contact between the insert and the cylinder head. Such an assembly is impractical, however, as the metals with the highest thermal conductivity, such as aluminum, copper, silver or gold, do not melt at normal engine operating conditions. Metals such as sodium or lead may not be compatible with the material used to make the insert, typically a powdered metal. In addition, repeated phase changes of the metallic coating could lead to unequal distribution of the coating upon resolidification resulting in localized "hot spots" due to insufficient thermal conduction.

SUMMARY OF THE INVENTION

Responsive to the above noted deficiences in the related art, the present invention provides a valve seat insert assembly with improved heat conduction between the insert and the cylinder head. The assembly is made by applying a thermally conductive paste to the insert bores in the cylinder head before the insert is pressed into place. The paste then fills the voids between the valve seat insert and the cylinder head thus decreasing the contact resistance therebetween to provide a good thermal contact.

Thus, one advantage of the present invention is lower thermal contact resistance between the engine cylinder head and the valve seat insert.

Another advantage is greater knock resistance and leaner air/fuel ratios at wide open throttle.

Still another advantage of the present invention is a decrease in engine valve operating temperatures resulting in enhanced conductive cooling of the valves.

A feature of the present invention is a high thermal conductivity metallic paste composed mostly of very fine metal powder applied between the cylinder head valve insert bores and the insert bores to fill the contact voids therebetween.

Another feature is a thermally conductive valve seat insert paste having a ceramic based binder in an aqueous solution which forms a strong bond between the metal powder of the paste as well as the cylinder head and valve seat inserts thus becoming a solid material.

BRIEF DESCRIPTION OF THE DRAWINGS

These and other objects, advantages and features of the present invention will be apparent to those skilled in the art upon reading the following description with reference to the accompanying drawings, in which.

DETAILED DESCRIPTION OF THE PREFERRED EMBODIMENTS

Figure 1:
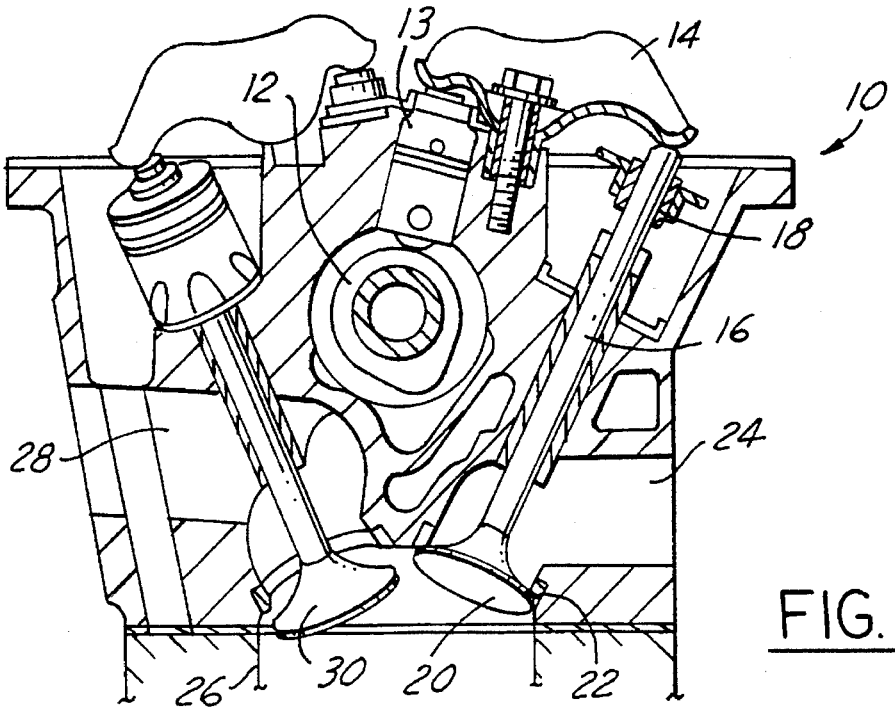
FIG. 1 is a sectional view of a cylinder head of an internal combustion engine showing an intake valve and an exhaust valve.

Referring now to the drawings, and particularly to FIG. 1, a cross-sectional view of an internal combustion engine cylinder head, shown generally at 10, has a cam shaft 12 which pivots a rocker arm 14 through a cam follower 13 in conventional fashion. Rocker arm 14 urges one end of a valve stem 16 in a longitudinal direction against the force of valve spring 18 to lift a valve head 20, attached at the other end of valve stem 16, from valve seat 22. Rotation of camshaft 12 cyclically seats and unseats valve head 20 from valve seat 22 to permit a fuel/air mixture to pass from a supply port 24 to a cylinder 26, in the case of an intake valve, or to allow exhaust gases to escape from the cylinder 26 to an exhaust port 28 in the case of an exhaust valve, generally indicated at 30.

Those skilled in the art will recognize that a typical automotive engine has more than one cylinder, and each cylinder typically has at least two valves situated as described in the cylinder head 10 with a valve seat for each valve. The following discussion will refer to a single valve 20, but it is to be understood that the present invention may equally apply to all the valves in the cylinder head 10.

Figure 2:
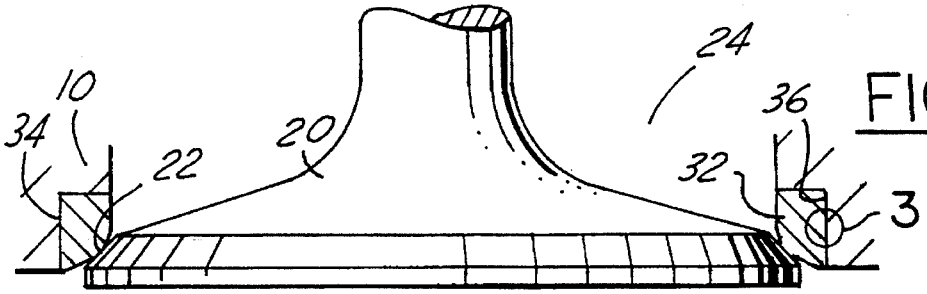
FIG. 2 is a perspective view showing a valve head seated on a valve seat insert.
Figure 3:
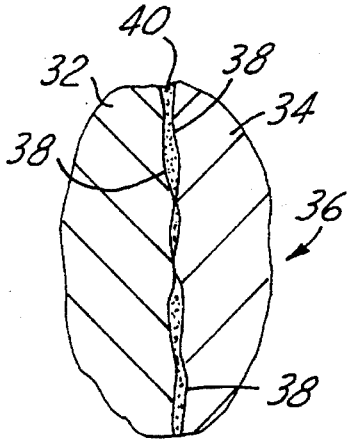
FIG. 3 is an enlarged view of a section of FIG. 2 showing contact voids between the cylinder head and the valve seat insert filled with a paste according to the present invention.
Figure 4:
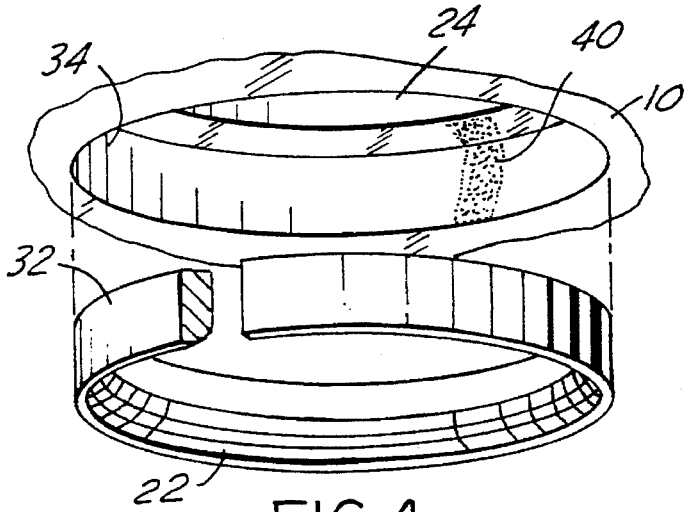
FIG. 4 is a perspective view of a cylinder head valve seat insert bore with a thermally conductive paste applied thereto prior to insertion of the valve seat insert.

Referring now to FIG. 2, the valve head 20 is shown seated on the valve seat 22 of a valve insert 32. The valve insert 32 is closely toleranced to fit into an annular valve insert bore 34 around a cylinder 26 end of the port 24 of the cylinder head 10 (FIG. 4). Even though the valve insert 32 is closely toleranced to fit within bore 34, voids, or air gaps, exist between the interfacing surfaces of the valve seat insert 32 and the insert bore 34. An enlargement of a section 36 (FIG. 2) of the interfacing surfaces is shown in FIG. 3. The voids 38 result in a higher thermal contact resistance between the valve seat insert 32 and the cylinder head 10, thus decreasing the amount of heat energy conducted from the valve head 20. As previously discussed, the exhaust valve head 20 is exposed to high temperatures, perhaps exceeding 1800° F. If not suitably cooled, valve head 20 may overheat resulting in improper seating on valve seat 22 with the undesirable results mentioned above.

As seen in FIG. 4, a thermally conductive paste 40 is applied to the valve insert bore 34 prior to pressing the valve seat insert 32 into place. The paste 40 fills the voids 38 (FIG. 3) at the interface between the cylinder head 10 and the valve seat insert 32 to provide lower contact resistance therebetween. Such a configuration enhances conductive cooling of the valve head 20 which is the dominant heat transfer mechanism. A valve head 20 temperature decrease in excess of 100° F. may be achieved due to the decreased contact resistance between the cylinder head 10 and the insert 34. Decreased valve temperatures will result in greater knock resistance and allow for leaner air/fuel ratios at wide open throttle.

The paste 40 preferably comprises a very fine metal powder, such as a blend of stainless steel and silicon carbide particles, mixed with a binder material, preferably an inorganic solution. Aluminum may also be used as the powder material. Approximately seventy percent (70%) powder is preferable, but other percentages may be used depending on the particular engine requirements. The blend of powder sizes can be varied to achieve a desired packing density.

The binder material, which wets both the cylinder head 10 and the valve seat insert 32 material, preferably is a ceramic based binder in an aqueous solution. A silicate based binder, such as a base stabilized sodium silicate ($SIO_2$) solution with a pH of approximately 12, is preferable, but a potasium silicate based binder may also be used. Preferably, the binder cures by exposure to temperatures between approximately 50°–100° F. The binder is fully cured by running the engine to completely drive off the water. During the curing process, the binder bonds aggressively to the powder, and to the bore 34 and the insert 32 to form a solid material therebetween. Such a binder can provide desirable thermal conduction in high temperature environments, such as an internal combustion cylinder, and may withstand temperatures up to approximately 2400° F. The resulting material is machinable yet fairly rugged, and is environmentally favorable.

A high temperature silicone oil or grease may also be used as the binder for paste 40.

Although the preferred embodiment of the present invention has been disclosed, various changes and modifications may be made without departing from the scope of the invention as set forth in the appended claims.

I claim:

1. A valve seat assembly for an internal combustion engine having a cylinder head with a plurality of valve seat insert bores therein, a plurality of valve seat inserts fitted into said plurality of bores, and a thermally conductive paste, comprised of a metal powder, between said bores and said inserts to fill voids therebetween.

2. A valve seat assembly according to claim 1 wherein said paste is comprised of approximately seventy percent (70%) metal powder.

3. A valve seat assembly according to claim 2 wherein said metal is aluminum.

4. A valve seat assembly according to claim 3 wherein said paste has a silicone oil binder.

5. A valve seat assembly according to claim 1 wherein said powder is made from stainless steel and silicon carbide particles.

6. A valve seat assembly according to claim 5 wherein said paste has a ceramic based binder in an aqueous solution.

7. A valve seat assembly according to claim 6 wherein the aqueous solution evaporates and said binder bonds to said powder, and to said bores and said inserts to form a solid material therebetween.

8. A valve seat assembly according to claim 7 wherein said ceramic based binder is comprised of a sodium silicate solution.

9. A valve seat assembly according to claim 8 wherein said ceramic based binder is comprised of a potasium silicate solution.

10. A cylinder head for an internal combustion engine having a valve seat assembly comprising:

a plurality of valve seat insert bores in the cylinder head;

a thermally conductive paste on an inner surface of the plurality of bores, the paste comprising a metal powder with a ceramic based binder in an aqueous solution; and a plurality of valve seat inserts fitted into the plurality of bores such that the paste fills voids between the inserts and the bores.

11. A cylinder head according to claim 10 wherein the aqueous solution evaporates causing the binder to bond to the powder, to the bores and to the inserts so that a solid material is formed therebetween.

12. A cylinder head according to claim 11 wherein the ceramic based binder is comprised of a sodium silicate solution.

13. A cylinder head according to claim 12 wherein the powder is made from stainless steel and silicon carbide particles.

14. A cylinder head according to claim 11 wherein said ceramic based binder is comprised of a potasium silicate solution.

15. A method for making a cylinder head for an internal combustion engine comprising the steps of:

forming a plurality of valve seat insert bores in the cylinder head;

applying a thermally conductive paste to an inner surface of the bores, the paste comprising a metal powder with a ceramic based binder in an aqueous solution; and fitting a plurality of valve seat inserts into the bores so that the paste fills voids between the inserts and the bores.

16. A method according to claim 15, further including the step of curing the paste by running the engine.

17. A method according to claim 15 wherein the paste comprises a stainless steel and silicon carbide powder with a sodium silicate solution binder which is cured by exposure to temperatures between approximately 50°–100° F.

* * * * *